US005608496A

United States Patent [19]

Hanzawa et al.

[11] Patent Number: 5,608,496

[45] Date of Patent: Mar. 4, 1997

[54] PRINT IMAGE POSITION INDICATION DEVICE

[75] Inventors: Hiroshi Hanzawa; Yoshikazu Hara; Masakazu Miyata, all of Minato-ku, Japan

[73] Assignee: Riso Kagaku Corporation, Tokyo, Japan

[21] Appl. No.: 332,032

[22] Filed: Nov. 1, 1994

[30] Foreign Application Priority Data

Nov. 12, 1993 [JP] Japan ..... 5-306034

[51] Int. Cl.[6] ..... G03G 21/00

[52] U.S. Cl. ..... 399/81; 345/115; 345/121

[58] Field of Search ..... 355/209, 218, 355/200; 364/927.63, 927.631, 927.632; 345/56, 61, 113, 121, 126, 131, 115

[56] References Cited

U.S. PATENT DOCUMENTS 4,855,726 8/1989 Nishio ..... 345/133
4,984,020 1/1991 Adachi et al. ..... 355/218
5,049,933 9/1991 Yamada ..... 355/218
5,083,162 1/1992 Hanamoto et al. ..... 355/218
5,172,167 12/1992 Ito ..... 355/218

*Primary Examiner*—Robert Beatty
*Attorney, Agent, or Firm*—Watson Cole Stevens Davis, P.L.L.C.

[57] ABSTRACT

In order to indicate more distinctly the results of transverse and longitudinal adjustments of a print image, in a printer image position indicating device, a standard print position indication mark showing a printing master being positioned at the standard position relative to a print sheet and a biased print position indication mark showing a biased position of the printing master in either or both of the transverse and longitudinal directions relative to the standard position are expressed as marks each including at least two straight lines perpendicular to one another, and the biased print position indication mark is biased in the transverse and/or longitudinal directions according to a corresponding biasing of the printing master relative to the print sheet. The standard print position mark and the biased print position mark are expressed by different kinds of lines so as to clearly contrast one against the other. In addition, the biased print position indication mark is biased at a greater rate than a ratio of a biasing amount of the printing master from the standard position to the site of the printing master.

8 Claims, 3 Drawing Sheets

PRINT IMAGE POSITION INDICATION DEVICE

BACKGROUND OF THE INVENTION

1. Field of the Invention

The present invention relates to the art of controlling printing means in printers or copiers, and more particularly to a device for indicating the results of adjustment by an adjusting means for adjusting the position of a print image relative to a print sheet in the printing means.

2. Description of the Prior Art

When a print image is applied to a print sheet by a printing means of a stencil printer or a copier adapted for use in offices, it is often desired that the transverse and/or longitudinal position of the print image relative to the print sheet is changed from the transverse and/or longitudinal position of an original image in a printing master or an original. In the art of electronic copiers it has been developed to adjust the longitudinal position of a print image relative to a print sheet through a step of electronic signal processing such that the longitudinal position of a print image relative to a print sheet is adjusted by a key operation made with reference to a linear scale. However, since an adjustment of the transverse position of a print image relative to a print sheet is relatively readily available by adjusting the transverse position of an original in the case of copiers, the art of adjusting the transverse position by keys does not yet appear to have been applied to copiers. In the art of stencil printing, when the perforation of a stencil sheet is carried out by a perforating means different from a printer such that a perforated stencil sheet is mounted around a printing drum by a manual operation as in the conventional stencil printers, an adjustment of the transverse position of a print image is relatively readily available by appropriately adjusting the transverse position of mounting the stencil sheet to the printing drum. However, with the development of a stencil printer which integrally incorporates a stencil perforation means therein, it has become necessary that an adjustment of the transverse position of a print image is made at the stage of setting an original for perforation of a stencil sheet when the perforation of the stencil sheet is carried out by the conventional art of laying an original and a stencil sheet one over the other, or a transverse adjustment of a print image is made while viewing a monitor screen of a word processor or the like when a stencil sheet is perforated by an electric input from the word processor or the like.

In view of the above-mentioned requirements for adjustments of the transverse and/or the longitudinal position of a print image and a limit of the conventional art in coping with the requirements, stencil printers capable of adjusting respectively the transverse position and the longitudinal position of a print image relative to a print sheet have been proposed by Japanese Patent Applications 5-306032 (corresponding to U.S. application 08/332,069) and 5-306233, respectively, filed by the same assignee as that of the present application.

SUMMARY OF THE INVENTION

In view of the art of adjustment of the transverse and longitudinal positions of a print image relative to a print sheet in the above newly developed stencil printers, it is an object of the present invention to provide a print image position indication device which provides an operator with a pleasant and effective indication of the results of an adjustment of the transverse and longitudinal positions of a print image relative to a print sheet when such adjustments are available in the printing means, regardless of the kind of printing means such as stencil printer, copier, etc., thereby further rendering the future developments of the art of adjustment of the print image transverse and longitudinal positions to be more effective.

According to the present invention, the above-mentioned object is accomplished by a print image position indication device for indicating the results of adjustment of a print image position in a printer capable of adjusting a transverse position and a longitudinal position of a print image relative to a print sheet, comprising a standard print position indication mark including at least two straight lines perpendicular to one another for indicating respectively a transverse position and a longitudinal position of a printing master positioned at a standard position thereof relative to a print sheet and a biased print position indication mark including at least two straight lines perpendicular to one another for indicating respectively a transverse position and a longitudinal position of the printing master biased in either or both of transverse and longitudinal directions from said standard position, wherein said biased print position indication mark is biased relative to said standard position indication mark in the same direction as and in accordance with a biasing of the print image relative to the print sheet in either or both of the transverse and longitudinal directions.

In the print image position indication device of the above-mentioned construction, said standard print position indication mark and said biased print position indication mark may each be of a rectangular configuration imitating an outline of the printing master.

Further, in the print image position indication device of the above-mentioned construction, said standard print position indication mark and said biased print position indication mark may each be of a configuration of cross or hook.

Further, in the print image position indication device of the above-mentioned construction, said biased print position indication mark may be biased relative to said standard print position indication mark at a substantially greater rate than a ratio of a biasing amount of the printing master from said standard position thereof to the size of the printing master.

Further, in the print image position indication device of the above-mentioned construction, a biasing amount of the printing master from the standard position thereof may be digitally indicated for a biasing of said biased print position indication mark from said standard print position indication mark.

Further in the print image position indication device of the above-mentioned construction, said standard print position indication mark and said biased print position indication mark may be expressed by lines of different kinds from one another for clearly contrasting one against the other.

Further in the print image position indication device of the above-mentioned construction, rectangular areas confined respectively by said standard print position indication mark and said biased print position indication mark may be colored to provide a clear color contrast against one another such that, when said biased print image indication mark is biased relative to said standard print position indication mark, an area located inside said standard print position indication mark but outside said biased print position indication mark, an area located inside said biased print position indication mark but outside said standard print position indication mark, and an area located inside said standard print position indication mark and also inside said biased print position indication mark present respective colors different from one another.

Further, or alternatively, in the print image position indication device of the above-mentioned constructing, rectangular areas confined respectively by said standard print position indication mark and said biased print position indication mark may be given with patterns different from one another making a clear contrast against one another such that, when said biased print position indication mark is biased relative to said standard print position indication mark, an area located inside said standard print position indication mark but outside said biased print position indication mark, an area located inside said biased print position indication mark but outside said standard print position indication mark, and an area located inside said standard print position indication mark and also inside said biased print position indication mark present respective patterns different from one another.

When the standard position of a printing master relative to a print sheet is indicated by the standard position indication mark including at least two straight lines perpendicular to one another showing the transverse and longitudinal positions of the printing master at the standard position as described above in the printing means capable of adjusting both the transverse and the longitudinal position of a print image relative to a print sheet, with a contrasting indication of the biased print position indication mark including at least two straight lines perpendicular to one another showing a transversely and longitudinally biased position of the printing master by a corresponding biasing in the transverse and longitudinal directions from the standard position, the operator is directly and simultaneously informed of the biasing amount in both the transverse and longitudinal directions of the print image from the standard position effected by the transverse and longitudinal position adjustment means in any optional direction, so that a desired adjustment condition with respect to the transverse and longitudinal positions is accomplished at high efficiency by the operator entering certain transverse and longitudinal adjustment instructions while viewing the print image position indication means.

Further, when the biased print position indication mark is biased from the standard print position indication mark at a rate substantially greater than the ratio of the biasing amount of the printing master from the standard position to the size of the printing master as described above, a fine adjustment such as less than 1 mm of a print image relative to a print sheet in the transverse or longitudinal direction is clearly recognized with respect to the degree of adjustment. In this connection, when the biasing amount of the printing master from the standard position is digitally indicated with respect to the biasing of the biased print position indication mark relative to the standard print position indication mark, the actual amount of adjustment can be clearly recognized on the print image position indication device.

Still further, when the standard print position indication mark and the biased print position indication mark are expressed by lines of different kinds making a distinct contrast against one another or the standard print position indication mark and the biased print position indication mark are each expressed by a rectangular configuration imitating the outline of a printing master with the rectangular areas confined respectively by the standard print position indication mark and the biased print position indication mark being colored to make a distinct color contrast against one another or given with patterns of different kinds making a distinct contrast against one another such that, when the biasing print image indication mark is biased relative to the standard print position indication mark, the area located inside the standard print position indication mark but outside the biased print position indication mark, the area located inside the biased print position indication mark but outside the standard print position indication mark, and the area located inside the standard print position indication mark and also inside the biased print position indication mark present different colors or patterns from one another as described above, an adjustment of the transverse and longitudinal positions is more distinctly recognized by a color contrast or a pattern contrast between the standard print position indication mark and the biased print position indication mark.

BRIEF DESCRIPTION OF THE DRAWING

In the accompanying drawing.

DESCRIPTION OF THE PREFERRED EMBODIMENTS

In the following the present invention will be described with respect to embodiments thereof with reference to the accompanying drawing.

Figure 1:
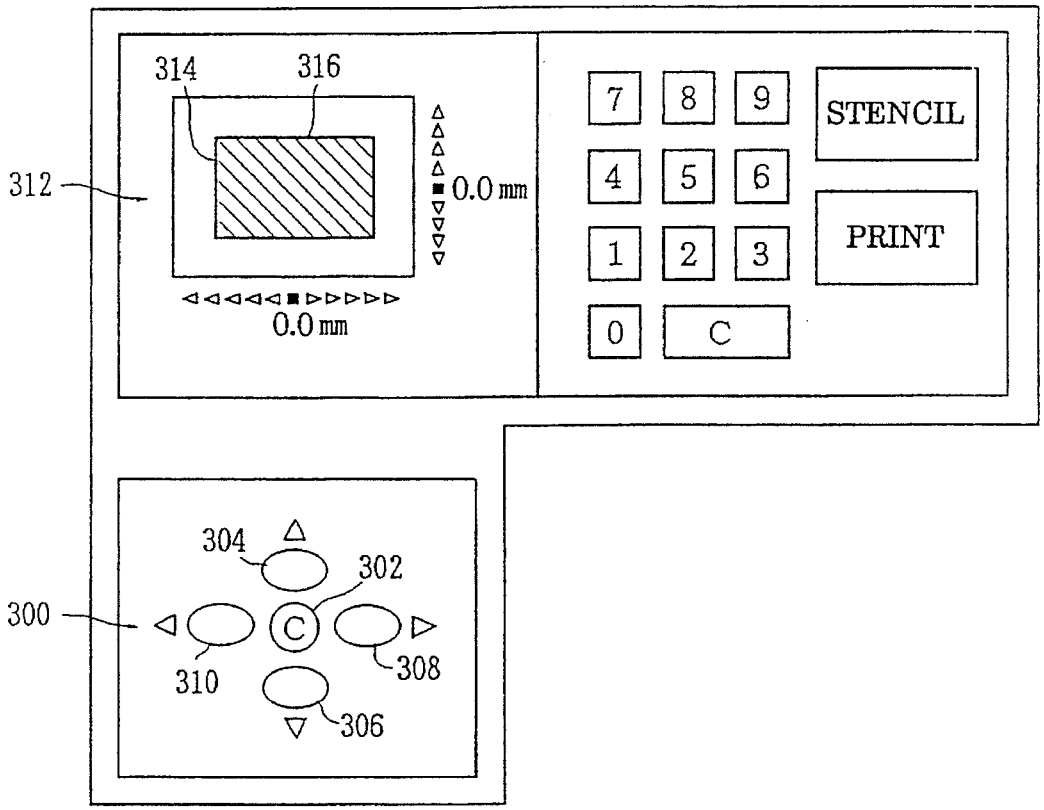
FIG. 1 is a somewhat diagrammatical front view showing an embodiment of the print image position indication device according to the present invention incorporated into a control panel of a stencil printer together with adjustment instruction means for adjustment of transverse and longitudinal positions of a print image.

Referring to FIG. 1 showing in a somewhat diagrammatical front view a part of control panel of a stencil printer integrally incorporating a printing means capable of transverse and longitudinal adjustments of a print image and a perforating means for perforating a stencil sheet, the part of the control panel herein shown is an embodiment of the print image position indication device according to the present invention. Such stencil printers capable of a transverse position adjustment of a print image relative to a print sheet and a stencil printer capable of a longitudinal position adjustment of a print image relative to a print sheet have sheet have been respectively proposed by Japanese Patent Applications 5-306032 (U.S. application 08/332,069) and 5-306033 filed by the same assignee as that of the present application.

In the control panel shown in the figure, the portion designated by reference numeral 300 is a part of a print image position instruction means for instructing an adjustment of the transverse and longitudinal positions of a print image relative to a print sheet, said print image position instruction means including a print image position restore instruction push button 302 for restoring the standard position by cancelling all preceding transverse and longitudinal adjustments, a leftward biasing instruction push button 310 for biasing a print image leftward as much as a predetermined amount such as, for example, 0.5 mm for each one time pushing thereof, a rightward biasing instruction push button 308 for biasing a print image rightward as much as the same amount for each one time pushing thereof, an upward biasing instruction push button 304 for biasing a print image upward as much as the same amount for each one time pushing thereof, and a downward biasing instruction push button 306 for biasing a print image downward as much as the same amount for each one time pushing thereof.

Figure 2:
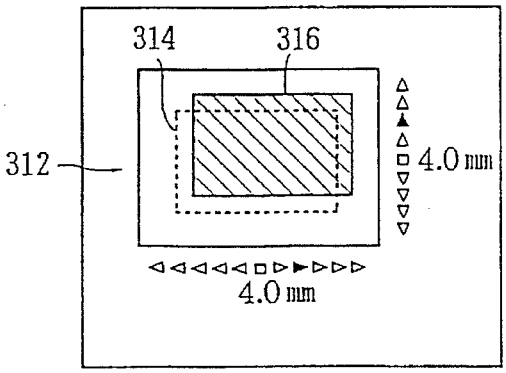
FIG. 2 is a front view showing the print image position indication device shown in FIG. 1 in a biased condition.

The portion designated by the reference numeral 312 is the print image position indication device according to the present invention. In the embodiment shown in. FIG. 1, the standard print position indication mark and the biased print position indication mark are both of a rectangular configuration, and FIG. 1 shows a condition in which a print image is at the standard position, whereas FIG. 2 shows a condition in which a print image is biased leftward as well as upward from the standard position. In these figures, the rectangular configuration designated by 314 is the standard print position indication mark, and the rectangular configuration designated by 316 is the biased print position indication mark. When the print image position is set at the standard position by the print image position restore instruction push button 302 having been pushed or the leftward, rightward, upward and downward biasing instruction push buttons 304–310 having been pushed to provide the respective balancing, the biased print position indication mark 316 is lapped just over the standard print position indication mark 314 as shown in FIG. 1, and from such a condition the biased print position indication mark 316 is shifted relative to the standard print position indication mark 314 like an example shown in FIG. 2 according to pushings of the leftward, rightward, upward and downward biasing instruction push buttons.

The transverse and/or longitudinal adjustment required for a print image to be biased relative to a print sheet is generally a fine adjustment. The adjustment means of the stencil printer incorporating the print image transverse position adjustment means or the print image longitudinal position adjustment means according to the afore-mentioned copending applications are also adapted for a fine adjustment of a print image in the transverse or longitudinal directions. Therefore, in the stencil printers according to the afore-mentioned copending applications and any other printers or copiers which will be developed in the future to incorporate some transverse and/or longitudinal position adjustment means having new constructions, the amount of biasing effected by the transverse and/or longitudinal adjustment of a print image relative to a print sheet will not be of such a great magnitude as exemplarily shown in FIG. 2 in contrast to the size of the print sheet. However, in the print image position indication device according to the present invention, the biased print position indication mark 316 is shifted relative to the standard print position indication mark 314 at a substantially greater rate relative to the size of the printing master than the ratio of the actual biasing amount of a print image relative to the size of the printing master as exemplarily shown in FIG. 2, for the purpose of clearly indicating how far the transverse and/or longitudinal fine adjustment of the print image relative to the standard position is effected by the print image position adjustment means. Therefore, even when the rate of biasing relative to the size of the printing master observable in the indication device is approximately 10% as exemplarily shown in FIG. 2 such that the amount of biasing would be 20–30 mm if the rate were proportionally converted into the amount of biasing, provided that the printing master is of the A4 size, the actual amount of the leftward biasing of the print image is 4.0 mm, while the actual amount of the upward biasing of the print image is 4.0 mm. Further, there are provided marks which indicate whether any transverse and/or longitudinal biasing is effected in either direction or not, and there are further provided means which digitally indicate the absolute values of the transverse and the longitudinal biasing. By these indications of the biasing directions and the absolute amounts of biasing in combination, the transverse and longitudinal biasing condition is directly observable.

In the shown embodiment, the standard print position indication mark 314 is expressed by a broken line, while the biased print position indication mark 316 is shown by a solid line, so that the difference between these two marks is more distinctly observable.

Figure 3:
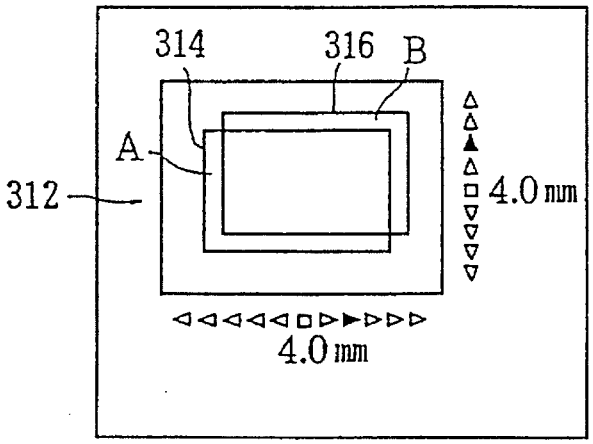
FIG. 3 is a view similar to FIG. 2, showing another embodiment with respect to more distinctly indicating the biasing adjustment of a print image.
Figure 4:
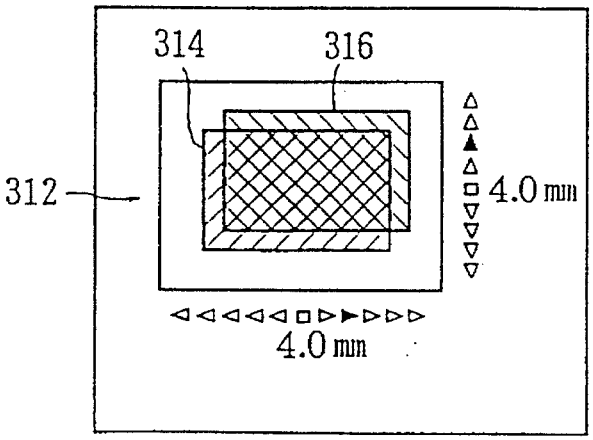
FIG. 4 is a view similar to FIG. 2, showing still another embodiment with respect to more distinctly indicating the biasing adjustment of a print image.

FIGS. 3 and 4 show two other embodiments employing a rectangular configuration for both the standard print position indication mark and the biased print position indication mark. In the embodiment shown in FIG. 3, although no reproduction is available in the figure, the rectangular area confined by the standard print position indication mark 314 and the rectangular area confined by the biased print position indication mark 316 are colored to colors A and B, respectively, which provide a distinct color contrast against one another, so that, when the biased print position indication mark 316 is biased relative to the standard print position indication mark 314, the area located inside the standard print position indication mark but outside the biased print position indication mark, the area located inside the biased print position indication mark but outside the standard print position indication mark, and the area located inside the standard print position indication mark and also inside the biased print position indication mark present respective colors different from one another.

In the embodiment shown in FIG. 4, the rectangular area confined by the standard print position indication mark 314 and the rectangular area confined by the biased print position indication mark 316 are give with oblique line hatchings of inclinations opposite to one another, so that when the biased print position indication mark is biased relative to the standard print position indication mark, the area located inside the standard print position indication mark but outside the biased print position indication mark, the area located inside the biased print position indication mark but outside the standard print position indication mark, and the area located inside the standard print position indication mark and also inside the biased print position indication mark present patterns different from one another.

Figure 5:
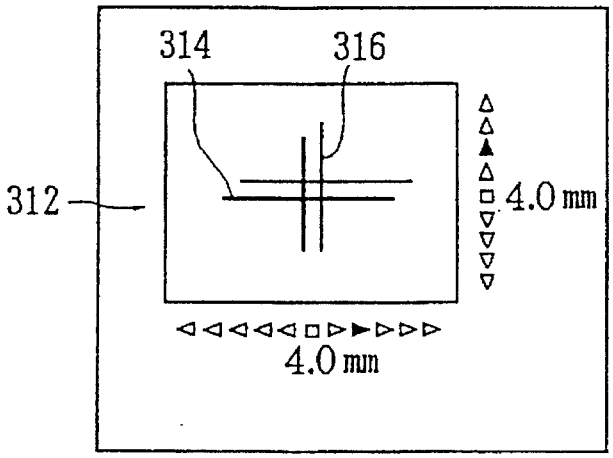
FIG. 5 is a front view showing still another embodiment of the print image position indication device according to the present invention in a biased condition.

FIG. 5 shows an embodiment in which the standard print position indication mark 314 and the biased print position indication mark 316 are each of a configuration of cross, the embodiment being shown in a biased condition similar to FIG. 2

Figure 6:
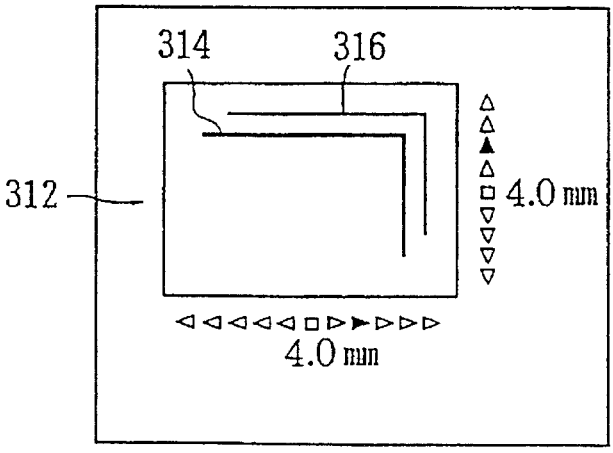
FIG. 6 is a front view showing still another embodiment of the print image position indication device according to the present invention in a biased condition.

FIG. 6 shows an embodiment in which the standard print position indication mark 314 and the biased print position indication mark 316 have each a configuration of hook, the embodiment being shown in a biased condition similar to FIG. 2.

According to these embodiments, the transverse and longitudinal biasing conditions are simultaneously directly observable by the two straight lines crossing or joining perpendicularly to one another.

Thus, according to the print image position indication device according to the present invention, in a printer capable of adjusting the transverse and longitudinal positions of a print image relative to a print sheet, the results of an image position adjustment in the transverse and longitudinal directions are directly and distinctly indicated as a composite two dimensional biasing.

Although the present invention has been described in detail with respect to some particular embodiments thereof, it will be apparent for those skilled in the art that other various embodiments are possible within the scope of the present invention.

We claim:

1. A print image position indication device for indicating the results of adjustment of a print image position in a printer capable of adjusting a transverse position and a longitudinal position of a print image relative to a print sheet, comprising a standard print position indication mark including at least two straight lines perpendicular to one another for indicating respectively a transverse position and a longitudinal position of a printing master positioned at a standard position thereof relative to a print sheet and a biased print position indication mark including at least two straight lines perpendicular to one another for indicating respectively a transverse position and a longitudinal position of the printing master biased in either or both of transverse and longitudinal directions from said standard position, wherein said biased print position indication mark is biased relative to said standard position indication mark in the same direction as and in accordance with a biasing of the print image relative to the print sheet in either or both of the transverse and longitudinal directions and said biased print position indication mark is also biased relative to said standard print position indication mark at a substantially greater rate than a ratio of a biasing amount of the printing master from said standard position thereof to the size of the printing master.

2. A print image position indication device according to claim 1, wherein said standard print position indication mark and said biased print position indication mark are each of a rectangular configuration imitating an outline of the printing master.

3. A print image position indication device according to claim 1, wherein said standard print position indication mark and said biased print position indication mark are each of a configuration of cross.

4. A print image position indication device according to claim 1, wherein said standard print position indication mark and said biased print position indication mark are each of a configuration of hook.

5. A print image position indication device according to claim 1, wherein a biasing amount of the printing master from the standard position thereof is digitally indicated for a biasing of said biased print position indication mark from said standard print position indication mark.

6. A print image position indication device according to claim 1, wherein said standard print position indication mark and said biased print position indication mark are expressed by lines of different kinds from one another for clearly contrasting one against the other.

7. A print image position indication device according to claim 2, wherein rectangular areas confined respectively by said standard print position indication mark and said biased print position indication mark are colored to provide a clear color contrast against one another such that, when said biased print image indication mark is biased relative to said standard print position indication mark, an area located inside said standard print position indication mark but outside said biased print position indication mark, an area located inside said biased print position indication mark but outside said standard print position indication mark, and an area located inside said standard print position indication mark and also inside said biased print position indication mark present respective colors different from one another.

8. A print image position indication device according to claim 2, wherein rectangular areas confined respectively by said standard print position indication mark and said biased print position indication mark are given with patterns different from one another making a clear contrast against one another such that, when said biased print position indication mark is biased relative to said standard print position indication mark, an area located inside said standard print position indication mark but outside said biased print position indication mark, an area located inside said biased print position indication mark but outside said standard print position indication mark, and an area located inside said standard print position indication mark and also inside said biased print position indication mark present respective patterns different from one another.

* * * * *